US005858035A

United States Patent [19]

Dunlop

[11] Patent Number: 5,858,035

[45] Date of Patent: Jan. 12, 1999

[54] PROCESS FOR PROCESSING COAL

[75] Inventor: Donald D. Dunlop, Miami, Fla.

[73] Assignee: Fuels Management, Inc., Miami, Fla.

[21] Appl. No.: 928,828

[22] Filed: Sep. 12, 1997

Related U.S. Application Data

[63] Continuation-in-part of Ser. No. 811,127, Mar. 3, 1997.

[51] Int. Cl.[6] ..... C10L 9/00

[52] U.S. Cl. ..... 44/626; 44/620

[58] Field of Search ..... 44/626

[56] References Cited

U.S. PATENT DOCUMENTS

| | | | |
|---|---|---|---|
| 4,213,752 | 7/1980 | Seitzer | 432/14 |
| 4,309,192 | 1/1982 | Kubo et al. | 44/51 |
| 5,035,721 | 7/1991 | Atherton | 44/594 |
| 5,087,269 | 2/1992 | Cha et al. | 44/626 |
| 5,145,489 | 9/1992 | Dunlop | 44/626 |
| 5,503,646 | 4/1996 | McKenny et al. | 44/620 |
| 5,527,365 | 6/1996 | Coleman et al. | 44/626 |
| 5,556,436 | 9/1996 | Yagaki et al. | 44/626 |
| 5,587,085 | 12/1996 | Yoon et al. | 210/711 |

*Primary Examiner*—Ellen M. McAvoy
*Attorney, Agent, or Firm*—Howard J. Greenwald

[57] ABSTRACT

A process for preparing an irreversibly dried coal. In the first step of this process, there is provided a fluidized bed reactor with a fluidized bed density of from about 20 to about 40 pounds cubic feet, which is at a temperature of from about 480 to about 600 degrees Fahrenheit. To this reactor is fed coal with a moisture content of from about 25 to about 30 percent, an oxygen content of from about 10 to about 20 percent, and a volatile matter content of from about 35 to about 45 percent; also fed to this reactor is from about 0.5 to about 3.0 weight percent (by weight of dried coal) of mineral oil with an initial boiling point of at least about 900 degrees Fahrenheit. A coated coal is produced in the reactor, and it is subjected to a temperature of from about 480 to about 600 degrees Fahrenheit for from about 1 to about 5 minutes while simultaneously being comminuted and dewatered. The comminuted and dewatered coal is passed to an elutriator in which said comminuted and dehydrated coal is contacted with air and separated into a coarse fraction and a fine fraction. The coarse fraction from the elutriator is fed to the fluidized bed, while the fine fraction from the elutriator is quenched to reduce its temperature to ambient temperature within about 5 seconds.

8 Claims, 5 Drawing Sheets

PROCESS FOR PROCESSING COAL

CROSS REFERENCE TO RELATED PATENT APPLICATION

This application is a continuation-in-part applicant's patent application U.S. Ser. No. 08/811,127 for "Process for Processing Coal," filed on Mar. 3, 1997, now U.S. Pat. No. 5,830,246. The entire disclosure of this application is hereby incorporated by reference into this specification.

FIELD OF THE INVENTION

A process for irreversibly removing moisture from coal while simultaneously reducing its particle size.

BACKGROUND OF THE INVENTION

Many coals contain up to about 30 weight percent of moisture. This moisture not only does not add to the fuel value of the coal, but also is relatively expensive to transport.

Consequently, many processes have been developed to dry coal. Illustrative of these processes is the one disclosed in U.S. Pat. No. 4,324,544 of Blake, in which coal is dried in a fluidized bed in which the heat necessary for drying is provided by partial combustion of the coal in the bed. By way of further illustration, U.S. Pat. No. 4,495,710 of Ottosan discloses a drying process in which particulate low rank coal is dried in a fluidized bed in which the coal is fluidized above a first portion of a gas flow distributor using a hot fluidizing gas, and also above a second portion of the gas flow distributor using a recycle gas stream at a temperature less than about 200 degrees Fahrenheit. The disclosure of each of these United States patents is hereby incorporated by reference into this specification.

The coal produced by the processes of the Blake and Ottosan patents suffers from two major disadvantages. In the first place, the drying process is reversible, and when the coal is allowed to stand in the presence of a moisture-laden atmosphere, it regains some or all of its initial water content. In the second place, the coal is often likely to undergo spontaneous combustion upon standing in air.

It is an object of this invention to provide a process for irreversibly removing moisture from coal which does not require substantial amounts of externally provided energy to drive it.

It is another object of this invention to provide a process for producing coal which is not likely to undergo spontaneous combustion.

It is yet another object of this invention to provide a process for comminuting coal without using mechanical grinding means.

It is yet another object of this invention to provide a coal which, even after it is stored under ambient conditions for prolonged periods of time, has a relatively high heating value.

It is yet another object of this invention to provide a novel coal-water slurry.

SUMMARY OF THE INVENTION

In accordance with this invention, there is provided a process for preparing an irreversibly dried coal. In the first step of this process, there is provided a fluidized bed reactor with a fluidized bed density of from about 20 to about 40 pounds cubic feet, wherein said reactor is at a temperature of from about 480 to about 600 degrees Fahrenheit. To this reactor is fed coal with a moisture content of from about 25 to about 30 percent, an oxygen content of from about 10 to about 20 percent, and a volatile matter content of from about 35 to about 45 percent; also fed to this reactor is from about 0.5 to about 3.0 weight percent (by weight of dried coal) of mineral oil with an initial boiling point of at least about 900 degrees Fahrenheit. A coated coal is produced in the reactor, and it is subjected to a temperature of from about 480 to about 600 degrees Fahrenheit for from about 1 to about 5 minutes while simultaneously being comminuted and dewatered. The comminuted and dewatered coal is passed to an elutriator in which said comminuted and dehydrated coal is contacted with air and separated into a coarse fraction and a fine fraction. The coarse fraction from the elutriator is fed to the fluidized bed, while the fine fraction from the elutriator is quenched to reduce its temperature to ambient temperature within about 5 seconds.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
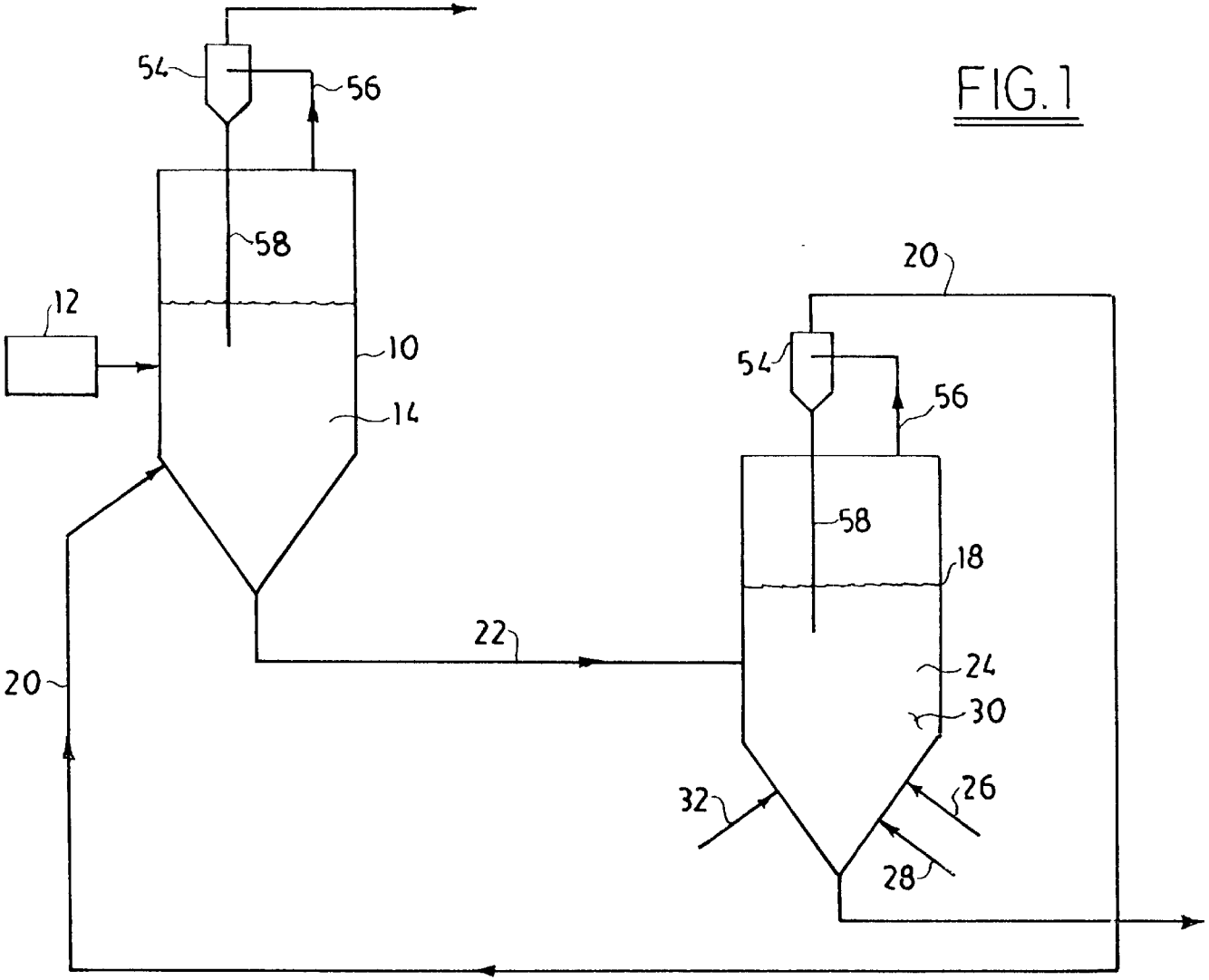
FIG. 1 is a schematic diagram of one preferred process of the instant invention.
Figure 2:
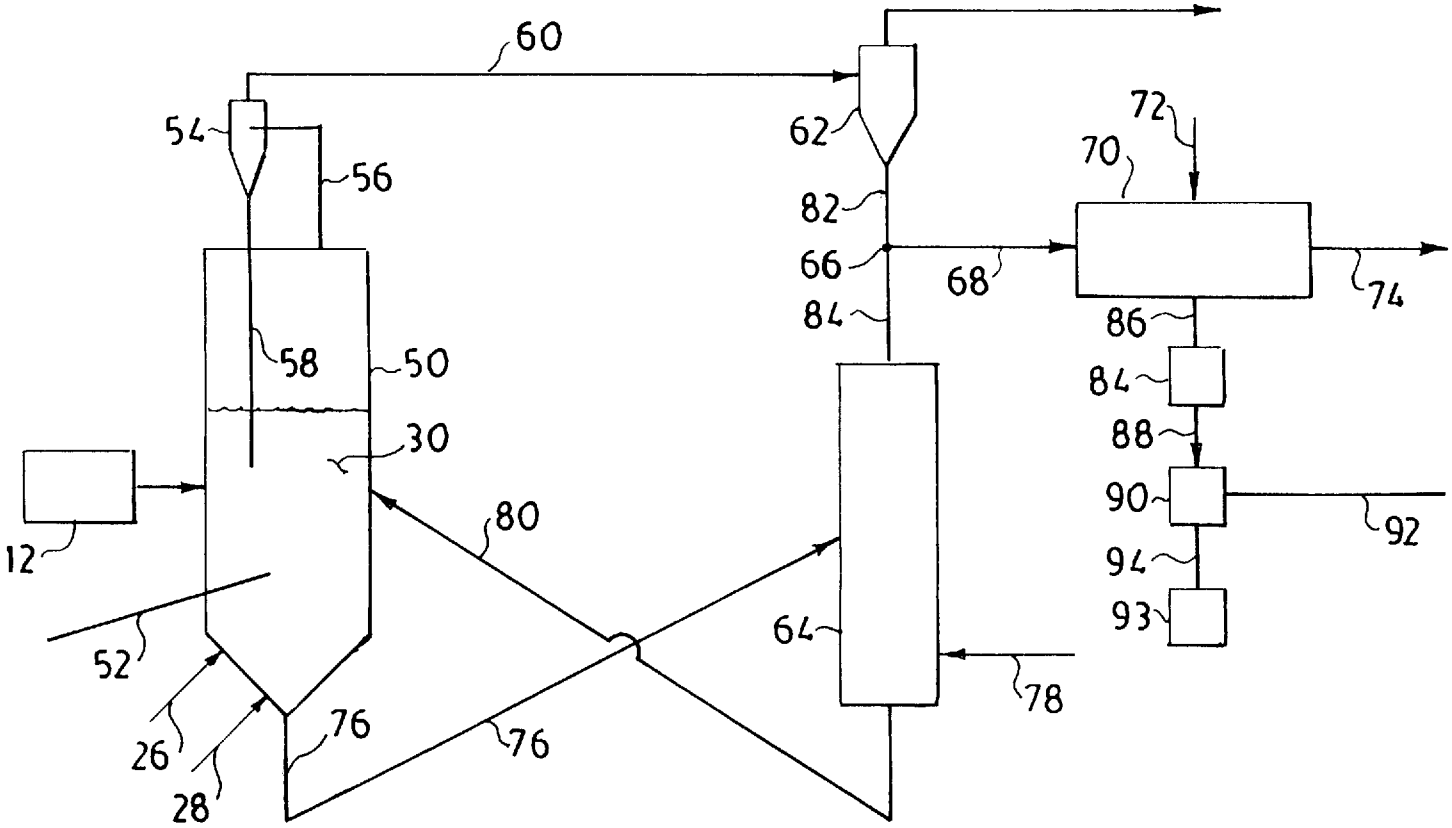
FIG. 2 is a schematic diagram of another preferred process of the instant invention.

At least two different processes are described in this specification. The first of such processes, illustrated in FIG. 1, is especially suitable for making a marketable coal from low rank coal. The second of these processes, illustrated in FIG. 2, is especially suitable for producing a marketable coal-fluid slurry from low rank coal, which normally contains 30 weight percent of water.

A Process for Producing Marketable Coal from Low Rank Coal

In the preferred process illustrated in FIG. 1, a low rank is is treated to produce a marketable coal is an economical process which produces irreversibly dried coal which is not susceptible to spontaneous combustion. In this process, the amount of coal fines in the finished product is minimized.

Referring to FIG. 1, a particular coal is charged to a fluidized bed reactor 10, preferably by means of a coal feeder 12. It is essential that the coal used in this process have certain properties. If other coals are used, the process will not function as well.

It is preferred that the coal used in the process of FIG. 1 contain from about 15 to about 30 weight percent of moisture and, more preferably, from about 20 to about 30 weight percent of moisture. As is known to those skilled in the art, the moisture content of coal may be determined by standard A.S.T.M. testing procedures. Means for determining the moisture content of coal are well known in the art; see, e.g., U.S. Pat. No. 5,527,365 (irreversible drying of carbonaceous fuels), U.S. Pat. No. 5,503,646, 5,411,560 (production of binderless pellets from low rank coal), U.S. Pat. No. 5,396, 260, 5,361,513 (apparatus for drying and briquetting coal), U.S. Pat. No. 5,327,717, and the like. The disclosure of each of these United States patents is hereby incorporated by reference into this specification.

It is also preferred that the coal used in the process of FIG. 1 contain at least about 10 weight percent of combined oxygen and, more preferably, from about 10 to about 20 weight of combined oxygen, in the form, e.g., of carboxyl groups, carbonyl groups, hydroxyl groups, and the like. As used in this specification, the term "combined oxygen" means oxygen which is chemically bound to carbon atoms in the coal. See, e.g., H. H. Lowry, Editor, "Chemistry of Coal Utilization" (John Wiley and Sons, Inc., New York, N.Y., 1963). Without wishing to be bound to any particular theory, applicant believes that his process will not function well unless the coal contains at least 10 weight percent of combined oxygen.

The combined oxygen content of coal may be determined by standard analytical techniques such as, e.g., U.S. Pat. Nos. 5,444,733, 5,171,474, 5,050,310, 4,852,384 (combined oxygen analyzer), U.S. Pat. No. 3,424,573, and the like. The disclosure of each of these United States patents is hereby incorporated by reference into this specification.

In one embodiment, the coal charged to reactor 10 contains at least about 10 weight percent of ash. Thus, e.g., in this embodiment one may use Wyodak C coal from Wyoming.

The term ash, as used in this specification, refers to the inorganic residue left after the ignition of combustible substances; see, e.g., U.S. Pat. Nos. 5,534,137 (high ash coal), U.S. Pat. No. 5,521,132 (raw coal fly ash), U.S. Pat. No. 4,795,037 (high ash coal), U.S. Pat. No. 4,575,418 (removal of ash from coal), 4,486,894 (method and apparatus for sensing the ash content of coal), and the like. The disclosure of each of these United States patents is hereby incorporated by reference into this specification.

Referring again to FIG. 1, the coal which is added to feeder assembly 12 may be, e.g., lignite, sub-bituminous, and bituminous coals. These coals are described in applicant's U.S. Pat. No. 5,145,489, the entire disclosure of which is hereby incorporated by reference into this specification.

The coal charged to reactor 10 preferably is 2"×0", and more preferably 2" by ¼" or smaller. As is known to those skilled in the art, 2" by ¼" coal has all of its particles within the range of from about 0.25 to about 2.0 inches.

As is known to those skilled in the art, crushed coal conventionally has the 2"×0" particle size distribution. This crushed coal can advantageously be used in applicant's process. The process of U.S. Pat. No. 4,324,544 of Blake, by comparison, requires coal which has been ground to 8 mesh or smaller.

Referring again to FIG. 1, the coal is fed into feeder 12. Feeder 12 can be any coal feeder commonly used in the art. Thus, e.g., one may use one or more of the coal feeders described in U.S. Pat. Nos. 5,265,774, 5,030,054 (mechanical/pneumatic coal feeder), U.S. Pat. No. 4,497, 122 (rotary coal feeder), U.S. Pat. Nos. 4,430,963, 4,353,427 (gravimetric coal feeder), U.S. Pat. No. 4,341,530, 4,142, 868 (rotary piston coal feeder), U.S. Pat. No. 4,140,228 (dry piston coal feeder), U.S. Pat. No. 4,071,151 (vibratory high pressure coal feeder with helical ramp), U.S. Pat. No. 4,149,228, and the like. The disclosure of each of these United States patents is hereby incorporated by reference into this specification.

Referring again to FIG. 1, and in the preferred embodiment depicted therein, feeder 12 is comprised of a hopper (not shown) and a star feeder (not shown). As will be apparent to those skilled in the art, it is preferred that feeder 12 be capable of continually delivering coal to fluidized bed 10.

In one embodiment, not illustrated, a star feeder is used. As is known to those skilled in the art, a star feeder is a metering device which may be operated by a controller which controls the rate of coal removal from a hopper; see, e.g., U.S. Pat. No. 5,568,896, the entire disclosure of which is hereby incorporated by reference into this specification.

Referring again to FIG. 1, a fluidized bed 14 is provided in a reactor vessel 10. The fluidized bed 14 is comprised of a bed of fluidized coal particles, and it preferably has a density of from about 20 to about 40 pounds per cubic foot. In one embodiment, the density of the fluidized bed 20 is from about 20 to about 30 pounds per cubic foot. As will be apparent to those skilled in the art, the fluidized bed density is the density of the bed while its materials are in the fluid state and does not refer to the particulate density of the materials in the bed.

Fluidized bed 14 may be provided by any of the means well known to those skilled in the art. Reference may be had, e.g., to applicant's U.S. Pat. No. 5,145,489, the entire disclosure of which is hereby incorporated by reference into this specification. Reference also may be had to U.S. Pat. Nos. 5,547,549, 5,546,875 (heat treatment of coal in a fluidized bed reactor), U.S. Pat. No. 5,197,398 (separation of pyrite from coal in a fluidized bed), U.S. Pat. No. 5,087,269 (drying fine coal in a fluidized bed), U.S. Pat. No. 4,571,174 (drying particulate low rank coal in a fluidized bed), U.S. Pat. No. 4,495,710 (stabilizing particulate low rank coal in a fluidized bed), U.S. Pat. No. 4,324,544 (drying coal by partial combustion in a fluidized bed), and the like. The disclosure of each of these United States patents is hereby incorporated by reference into this specification.

Referring again to FIG. 1, fluidized bed 14 is preferably maintained at a temperature of from about 150 to about 200 degrees Fahrenheit. In a more preferred embodiment, the fluidized bed 14 is maintained at a temperature of from about 165 to about 185 degrees Fahrenheit.

Various means may be used to maintain the temperature of fluidized bed 14 at a temperature of from about 150 to about 200 degrees Fahrenheit. Thus, e.g., one may use an internal or external heat exchanger (not shown). See, e.g., U.S. Pat. Nos. 5,537,941, 5,471,955, 5,442,919, 5,477,850, 5,462,932, and the like. The disclosure of each of these Unites States patents is hereby incorporated by reference into this specification.

In one embodiment, illustrated in FIG. 1, hot gas from, e.g., a separate fluidized bed reactor 18 is fed via line 20 into fluidized bed 14. This hot gas preferably is at temperature of from about 480 to about 600 degrees Fahrenheit and, more preferably, at a temperature of from about 525 to about 575 degrees Fahrenheit.

The coal removed from fluidized bed 14 is partially dehydrated. The untreated coal charged to reactor 10 generally has a moisture content of from about 25 to about 30 weight percent. The coal which is removed from fluidized bed 14 generally contains no more than about 15 weight percent moisture.

The partially dehydrated coal is passed via line 22 to fluidized bed reactor 18, in which a fluidized bed 24 is preferably maintained at a temperature of from about 480 to about 600 degrees Fahrenheit and, more preferably, from about 525 to about 575 degrees Fahrenheit.

Referring again to FIG. 1, in addition to dehydrated coal being charged via line 22 to bed 24, one also charges air via line 26, water via line 28, and oil via line 32. In one embodiment, the fluidized bed 24 is fluidized with the air introduced via line 26, and the temperature of the bed is controlled with the water introduced via line 28.

The dehydrated coal, air, and water are introduced at rates sufficient to produce a fluidized bed with a density of from about 20 to about 40 pounds per cubic foot and, more preferably, from about 25 to about 35 pounds per cubic foot.

Thus, referring to FIG. 1, air may be flowed into the system via line 26. The air may be at ambient temperature, or it may be heated, as required to maintain the desired temperature.

Thus, by way of further illustration, and again referring to FIG. 1, liquid water may be introduced via line 28. Again, depending upon the temperature control desired, the liquid water may be at ambient temperature.

It will be apparent to those skilled in process control that the quantities of air and/or water, and their temperatures, may be varied to maintain the desired temperature within the fluidized bed 24.

The temperature within fluidized bed 24 may be monitored by conventional means such as, e.g., by means of thermocouple 30.

The coal fed to fluidized bed 24 via line 22 preferably is maintained in fluidized bed 24 for from about 1 to about 5 minutes, and preferably for from about 2 to about 3 minutes, while being subjected to the aforementioned temperature of from about 480 to about 600 degrees Fahrenheit.

Referring again to FIG. 1, and in the preferred process depicted therein, oil is fed via line 32 into fluidized bed 24.

The oil used in the process depicted in FIG. 1 preferably has an initial boiling point of at least 900 degrees Fahrenheit. Thus, e.g., one may use a mineral oil with an initial boiling point of at least 900 degrees Fahrenheit. As is known to those skilled in the art, mineral oils are derived from petroleum coal, shale and the like and consist essentially of hydrocarbons.

By way of illustration, and not limitation, one may use residual fuel oil, heavy crude oil, coal tars, and the like, as long as they have an initial boiling point at least 900 degrees Fahrenheit. As is known to those skilled in the art, the initial boiling point of a mineral oil is the recorded temperature when the first drop of distilled vapor is liquefied and falls from the end of the condenser. See, e.g., U.S. Pat. No. 5,451,312 (initial boiling point of a hydrocarbon fraction), U.S. Pat. No. 5,382,728 (initial boiling point of a hydrocarbon blend), U.S. Pat. No. 5,378,739, 5,370,808 (initial boiling point of a petroleum oil), and the like. The disclosure of each of these United States patents is hereby incorporated by reference into this specification.

In one embodiment, the oil used is residual fuel oil. As is known to those skilled in the art, residual fuel oil, which is often referred to as "residual oil," refers to the combustible, viscous, or semiliquid bottoms produced from crude oil distillation. see, e.g., U.S. Pat. Nos. 4,512,774, 4,462,810, 4,404,002, 4,297,110, 3,977,823, 3,691,063, and the like. The entire disclosure of each of these United States patents is hereby incorporated by reference into this specification.

Referring again to FIG. 1, the oil fed via line 32 preferably is fed at rate so that, within fluidized bed 24, from about 0.5 to about 3.0 weight percent of such oil is present, based upon the weight of dried coal withdrawn from fluidized bed 24 via line 34. Thus, e.g., for every 100 parts of dried coal withdrawn from fluidized bed 24 per unit of time, from about 0.5 to about 3.0 parts of oil would be contained thereon and, thus, would have to be introduced via line 32 to produce the desired condition.

The dried coal produced in applicant's process contains from about 0.5 to about 3.0 weight percent of oil (by weight of dried coal), and from about 0 to about 2.0 weight percent of moisture.

Applicant has discovered that, unexpectedly, the use of his process produces a comminution of the coal fed into the fluidized bed. Without wishing to be bound to any particular theory, applicant believes that, in his process, the coal is caused to disintegrate by the escape of steam from the coal at an extremely high rate.

In one embodiment, not shown, the comminution of the coal is enhanced by conventional attrition devices. It is known to those that attrition may be increased by the addition of impact targets or other such devices.

The coal produced by applicant's process is irreversibly dried. Thus, when such coal is allowed to sit in an environment at a temperature of 25 degrees Centigrade at a relative humidity of exceeding 50%, it will pick up less than 2.0 percent of moisture from this environment in 48 hours.

In one embodiment, the dried coal produced by applicant's process contains from about 0 to about 2 weight percent of moisture, from about 8 to about 10 weight percent of ash, from about 36 to 39 weight percent of volatile matter, and from about 50 to about 65 weight percent of carbon.

In one aspect, the dried coal produced by this embodiment contains a relatively large amount of volatile matter. As is known to those skilled in the art, volatile matter is any material which volatilizes at a temperature of 900 degrees Centigrade in an inert atmosphere, and its presence in coal may be analyzed by conventional means. See, e.g., U.S. Pat. Nos. 5,605,722, 5,601,631, 5,568,777, 5,551,958, 5,512,074, 5,435,983, 5,389,117, 5,374,297, 5,366,537, 4,459,103 (automatic volatile matter content analyzer), U.S. Pat. No. 4,257,778 (process for preparing coal with a high volatile matter content), and the like. The disclosure of each of these United States patents is hereby incorporated by reference into this specification.

Without wishing to be bound to any particular theory, applicant believes that the volatile matter in the dried coal produced by this aspect of the invention contains organic materials.

A Process for Producing Liquid Fuel

In the process described in this portion of the specification, a coal product with increased fines content is produced. FIG. 2 is a schematic representation of this process, which is especially suitable for producing a coal/liquid slurry from the low rank coal.

As discussed in applicant's U.S. Pat. No. 5,145,489, the most abundant coal resource in western North America and Canada is the low rank coals. The disclosure of this patent is hereby incorporated by reference into this specification.

The process described in this section of the specification enables one to produce a combustible, high-quality coal-water slurry from low rank coals. As will be apparent to those skilled in the art, making a high-solids content slurry from coal which already contains about 30 weight percent of moisture is no easy task.

FIG. 2 illustrates this process. Referring to FIG. 2, the low rank coal described elsewhere in the specification is fed into feeder 12 and thence into fluidized bed reactor 50. Air is fed into reactor 50 via line 26 and a sufficient rate vis-a-vis the coal feed to maintain the fluidized bed 52 so that its temperature is from about 480 to about 600 degrees Fahrenheit and its density is from about 20 to about 40 pounds per cubic foot. Water is fed to the fluidized bed 52 via line 28 as necessary to provide temperature control.

As will be apparent to those skilled in the art, the fluidized bed 52 is substantially identical to the fluidized bed 24 (see FIG. 1) with the exception that the coal fed to bed 52 is not at least partially dehydrated, and with the additional exception that the coal fed to bed 52 is not at least partially comminuted. In general, the coal fed to bed 52 contains at least about 25 weight percent of moisture, depending upon ambient conditions, and frequently contains at least about 30 weight percent of moisture. Furthermore, the coal fed to bed 52 generally has a particle size in the range of from 2" by 0".

Without wishing to be bound to any particular theory, applicant believes that the use of this wetter, coarser coal in the fluidized bed 52 will cause a greater degree of comminuition than that occurring in fluidized bed 24.

Referring again to FIG. 2, it will be apparent that, in the preferred embodiment depicted, the finer coal portions will be entrained from the top of the fluid bed 52 to the cyclone 54, via line 56. It will also be apparent that the coarser component of the entrained stream will be returned to the fluidized bed 52 via line 58.

One may use any of the cyclones conventionally used in fluid bed reactors useful for separating solids from gas. Thus, by way of illustration and not limitation, one may use as cyclone 54 the cyclones described in U.S. Pat. No. 5,612,003 (fluidized bed with cyclone), U.S. Pat. No. 5,174,799 (cyclone separator for a fluidized bed reactor), U.S. Pat. Nos. 5,625,119, 5,562,884, and the like. The disclosure of each of these United States patents is hereby incorporated by reference into this specification.

The fine portion from cyclone 54 is passed via line 60 a second cyclone 62. The fine portion from cyclone 62 is contacted with a fine portion from elutriator 64 at point 66, and the mixture thus produced is then passed via line 68 to quench vessel 70, wherein water is added via line 72. The quenched product is then passed via line 74 to a coal-water fuel preparation plant (not shown).

Referring again to FIG. 2, it will be seen that comminuted coal from fluid bed 52 is passed via line 76 to elutriator 64. As will be apparent to those skilled in the art, the function of elutriator 64 is to separate fine particles from coarser particles by means of gravity.

One may use any of the elutriators known to those skilled in the art as elutriator 64. Thus, e.g., one may use one or more of the elutriators disclosed in U.S. Pat. Nos. 5,518,188, 5,497,949, 4,755,284, 4,670,002, 4,350,283, 3,825,175, 3,482,692, and the like. The disclosure of each of these United States patents is hereby incorporated by reference into this specification.

Referring again to FIG. 2, and in the preferred embodiment illustrated therein, air is added to elutriator 64 via line 78 and acts as the elutriating gas. The coarse fraction from elutriator 64 is recycled and passed via line 80 back to fluidized bed 52 for additional comminution.

It will be apparent to those skilled in the art that elutriating gases other than air may be used. Thus, e.g., one may alternatively or additionally use flue gas.

The cyclone separator 62 is designed to capture any solids which leave cyclone 54 via overhead line 60 and to return them to the system. These solids are passed via line 82, where the stream of solids contacts a stream of gas and solids from elutriator 64 (via line 84) at point 66.

The mixture of materials from lines 82 and 84 is passed via line 68 to quench 70, wherein it is contacted with water which introduced into quencher 70 via line 72. It is preferred that the water be at ambient temperature, and it is preferred that be introduced at a rate sufficient to reduce the temperature of the coal particles within about 5 seconds to ambient temperature.

Without wishing to be bound to any particular theory, applicant believes that this rapid cooling effects further comminution of the coal particles.

In one embodiment, depicted in FIG. 2, the coal from quencher 70 is passed to a mixer/grinder/blender 84 via line 86 wherein it may be mixed with one or more additional coal fractions to obtain any desired particle size distribution.

In one preferred embodiment, the blending occurs in such a manner to approach the particle size distribution disclosed in U.S. Pat. No. 4,282,006, the entire disclosure of which is hereby incorporated by reference into this specification. If the nature of the coal fraction(s) in mixer/grinder/blender is not suitable for making such particle size distribution, the coal may be further ground as disclosed in such patent.

The slurry produced in applicant's process possesses some unexpected, beneficial results. In the first place, this slurry is substantially more combustible than prior art slurries. It is believed that such combustibility is due to a relatively high oxygen content, and a relatively high level of volatile material.

Referring again to FIG. 2, and in one preferred embodiment, after the coal segments have been blended in blender 84 they then may be beneficiated in a froth flotation cell or other conventional coal cleaner 90.

Froth flotation cleaning of coal is well known; see, e.g., U.S. Pat. Nos. 5,379,902, 4,820,406, 4,770,767, 4,701,257, 4,676,804, 4,632,750, 4,532,032, and the like. The disclosure of each of these United States patents is hereby incorporated by reference into this specification.

Referring again to FIG. 2, the ash may be removed from froth flotation cell 90 via line 92, and the cleaned coal may be passed to slurry preparation tank 93 via line 94.

In one embodiment of this invention, the cleaned coal is used to prepare a coal-water slurry in accordance with the teachings of U.S. Pat. No. 4,477,259, the disclosure of which is hereby incorporated by reference into this specification. This slurry preferably contains from about 60 to about 82 weight percent of coal, from about 18 to about 40 weight percent of carrier liquid (such as, e.g., water), and from about 0.1 to about 4.0 weight percent, by weight of dry coal) of dispersing agent. This slurry preferably should have a specific surface area of from about 0.8 to about 4.0 square meters per cubic centimeter and an interstitial porosity of less than 20 volume percent. In one aspect of this embodiment, the slurry has a particle size distribution such that from about 5 to about 70 weight percent of the particles of coal in the slurry are of colloidal size, being smaller than about 3 microns.

The following examples are presented to illustrate the claimed invention but are not to be deemed limitative thereof. Unless otherwise specified, all parts are by weight, and all temperatures are in degrees Fahrenheit.

EXAMPLE

The experiments of this example were conduced in a modular fluidized bed unit constructed by the Battelle Memorial Institute of Columbus, Ohio. This modular bed unit is illustrated schematically in FIG. 3.

Figure 3:
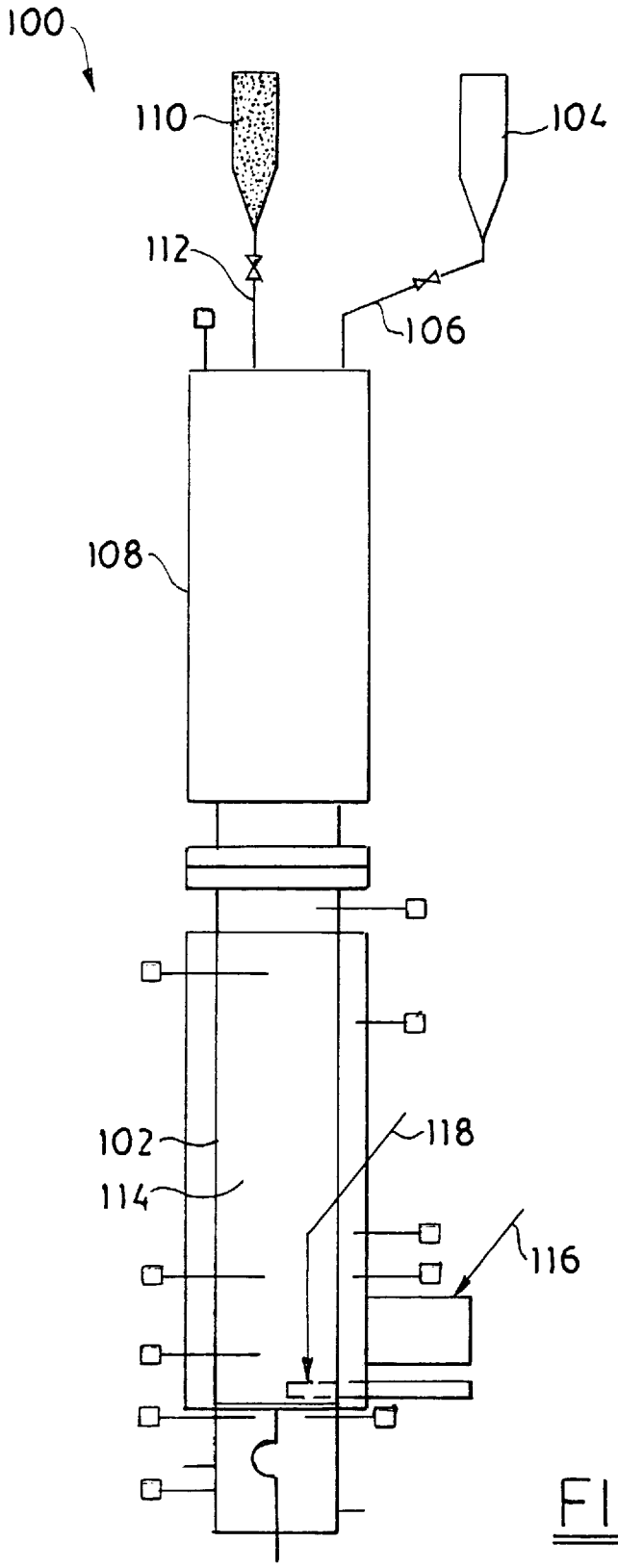
FIG. 3 is a schematic of a test apparatus used to conduct certain experiments described in this specification.
Figure 4A:
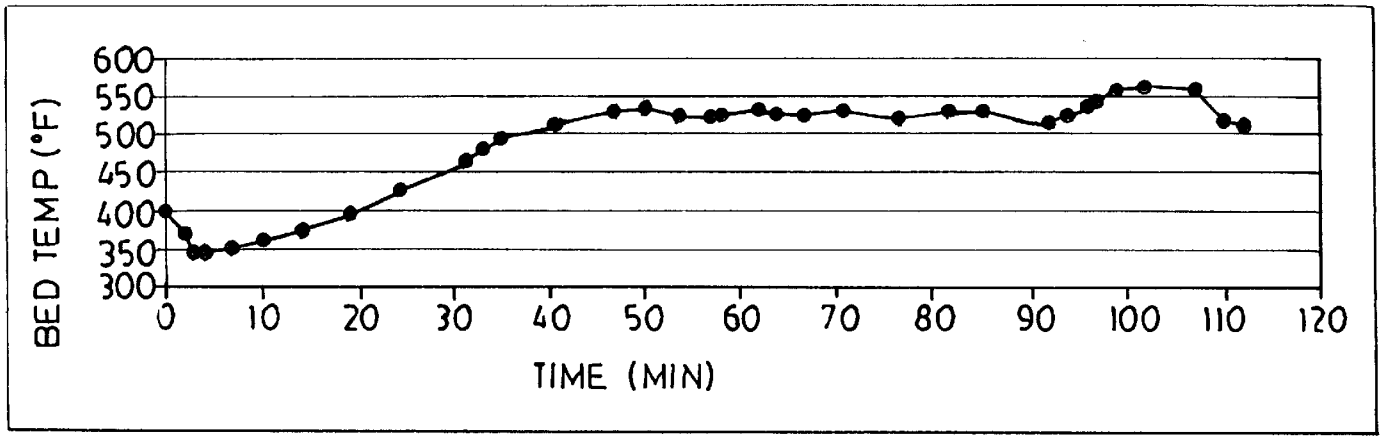
FIGS. 4A, 4B, 4C, and 4D are graphs of data obtained from a series of experiments involving one of applicant's processes in which the bed temperature of the reactor, the carbon monoxide concentration in the off gas produced, the carbon dioxide concentration in the off gas produced, and the oxygen concentration in the off gas produced are plotted as a function of time and illustrated in FIGS. 4A, 4B,, 4C, and 4D, respectively.
Figure 4B:
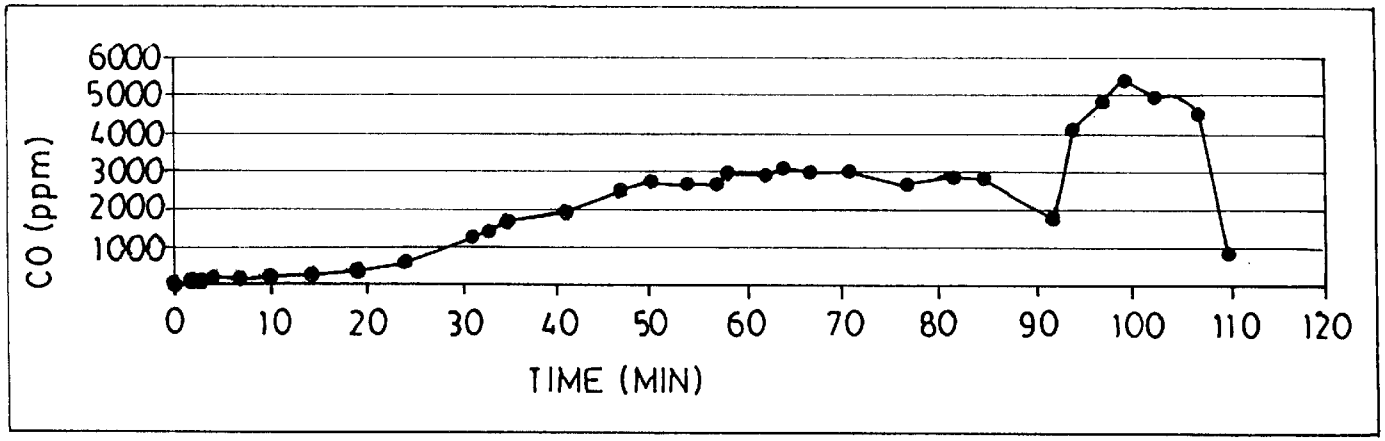
Figure 4C:
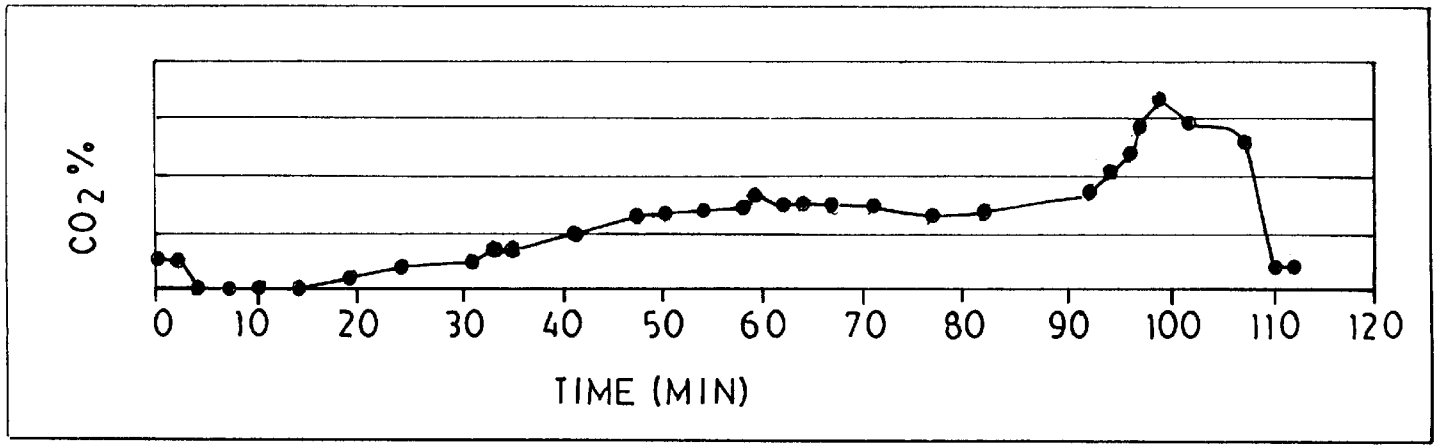
Figure 4D:
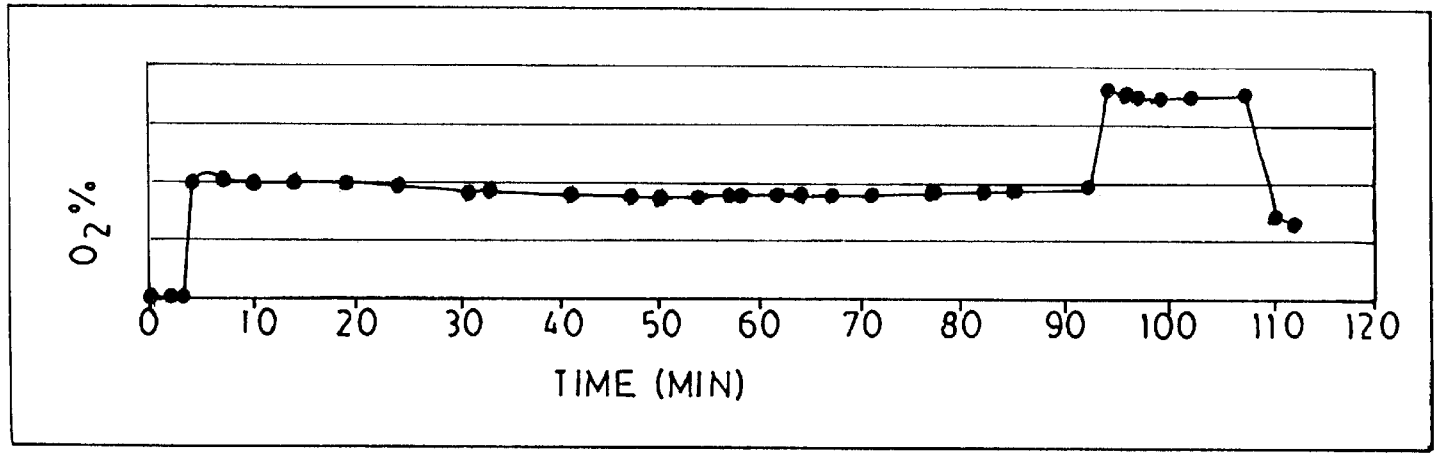

Referring to FIG. 3, it will be seen that unit 100 was comprised of a 12" diameter×6 foot high reactor chamber 102 into which was charged 100 pounds of sand 104 via line 106. The sand was disposed in the bed to act as a diluent and a heat transfer medium.

The top of the fluidized bed was connected to a disengaging chamber 108 which had an inner diameter of 2.0 feet and a length of 6 feet.

50 pounds of Wyodak coal, which was obtained from the Montana Power Corporation mine in Colestrip, Mont., was charged from coal supply vessel 110 via line 112.

The coal was charged via coal supply vessel 110 after the sand had been brought the desired temperature. The fluid bed section 114 was heated by an annular burner 116.

After the sand had been heated to the desired temperature, the sand was fluidized with either pure air, or air/nitrogen mixtures, which were introduced into the system by line 118.

After the sand had been fluidized, the coal was added to produce a fluidized bed density of about 30 pounds per cubic foot.

During the operation of the fluidized bed, the off gas produced was continually monitored by an oxygen sensor (not shown), a carbon monoxide sensor (not shown), and a carbon dioxide sensor (not shown). Furthermore, the temperature of the fluidized bed was recorded about every five minutes.

The results of these experiments are illustrated in FIGS. 4A, 4B, 4C, and 4D. It should be noted that, when the oxygen content in the off gas was about 10 volume percent, the levels of carbon monoxide and carbon dioxide in the off gas were relatively low. As will be apparent to those skilled in the art, the levels of carbon monoxide and carbon dioxide in the off gases are directly related to the extent to which heat is being released by the coal in the system.

When the oxygen in the off gas was increased by about 60 percent, the quantities of carbon monoxide and carbon dioxide in the off gas more than doubled, indicating a rapid and unexpected increase in the rate of heat release from the coal.

Applicant believes that this result in unexpected because of the phenomena occurring during combustion of hydrocarbons. As is known to those skilled in the art, during the combustion of hydrocarbons, when the oxygen in the off gas is only a few percent, combustion is substantially complete; the fact that oxygen exists in the off gas indicates that the stoichiometric amount of oxygen has reacted and some is left over.

Consequently, in classical combustion reactions, increasing the amount of air fed to the system has no effect upon the rate of combustion. Unexpectedly, as is indicated by the aforementioned experiments, when in applicant's process the oxygen in the off gas was increased by about 60 percent, the quantities of carbon monoxide and carbon dioxide in the off gas more than doubled.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A process for preparing an irreversibly dried coal, comprising the steps of:

(a) providing a fluidized bed reactor with a fluidized bed density of from about about 20 to about 40 pounds per cubic foot, wherein said reactor is at at a temperature of from about 480 to about 600 degrees Fahrenheit, (b) feeding to said reactor coal with a moisture content of at least about 25 percent, an oxygen content of from about 10 to about 20 percent, and a volatile matter content of from about 35 to about 45 percent, (c) feeding to said reactor from about 0.5 to about 3.0 weight percent (by weight of dried coal) of mineral oil with an initial boiling point of at least about 900 degrees Fahrheit, thereby producing a coated coal, (d) subjecting said coated coal to said temperature of from about 480 to about 600 degrees Fahrenheit for from about 1 to about 5 minutes while simultaneously comminuting and dewatering said coated coal, whereby a comminuted and dehydrated coal, is produced;

(e) passing said comminuted and dehydrated coal to an elutriator in which said comminuted and dehydrated coal is contacted with air and separated into a first coarse fraction and a first fine fraction, (f) passing said first coarse fraction from said elutriator to said fluidized bed, and (g) quenching said first fine fraction from said elutriator and reducing its temperature to ambient temperature within about 5 seconds.

2. The process as recited in claim 1, wherein said fluidized bed has a density of from about 20 to about 30 pounds per cubic foot.

3. The process as recited in claim 2, wherein said coal has a particle size in the range of from 2" by 0".

4. The process as recited in claim 3, further comprising the step of entraining a stream of coal from the top of said fluidized bed to a second cyclone.

5. The process as recited in claim 4, further comprising the step of separating said stream of coal into a second coarse fraction and a second fine fraction.

6. The process as recited in claim 5, further comprising the step of returning said second coarse fraction to said fluidized bed reactor.

7. The process as recited in claim 6, further comprising the step of passing said second fine fraction to a second cyclone and separating said second fine fraction into a third coarse fraction and a third fine fraction.

8. The process as recited in claim 7, further comprising the step of combining said third fine fraction with said first fine fraction, thereby producing a combined fine fraction.

* * * * *